US012662796B2

(12) United States Patent
Fujiwara et al.

(10) Patent No.: US 12,662,796 B2
(45) Date of Patent: Jun. 23, 2026

(54) WORK MACHINE

(71) Applicant: KOBELCO CONSTRUCTION MACHINERY CO., LTD., Hiroshima (JP)

(72) Inventors: Sho Fujiwara, Hiroshima (JP); Daisuke Noda, Hiroshima (JP); Masaki Akiyama, Hiroshima (JP); Yuma Morota, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 127 days.

(21) Appl. No.: 18/705,772

(22) PCT Filed: Sep. 28, 2022

(86) PCT No.: PCT/JP2022/036126

§ 371 (c)(1),
(2) Date: Apr. 29, 2024

(87) PCT Pub. No.: WO2023/089961

PCT Pub. Date: May 25, 2023

(65) Prior Publication Data

US 2025/0003188 A1 Jan. 2, 2025

(30) Foreign Application Priority Data

Nov. 17, 2021 (JP) ..... 2021-186762

(51) Int. Cl.
*E02F 9/02* (2006.01)
*E02F 9/20* (2006.01)
*E02F 9/26* (2006.01)

(52) U.S. Cl.
CPC ..... *E02F 9/2025* (2013.01); *E02F 9/264* (2013.01)

(58) Field of Classification Search
CPC ..... E02F 3/437; E02F 9/2025; E02F 9/2033; E02F 9/264
See application file for complete search history.

(56) References Cited

U.S. PATENT DOCUMENTS 7,464,063 B2 * 12/2008 Vatchkov ..... G06N 3/08 706/45
7,831,333 B2 * 11/2010 Sawodny ..... B66C 23/94 700/218

(Continued)

FOREIGN PATENT DOCUMENTS

EP 3 680 394 A1 7/2020
JP 62-21 4406 A 9/1987

(Continued)

OTHER PUBLICATIONS

International Search Report mailed on Nov. 15, 2022 in PCT/JP2022/036126 filed on Sep. 28, 2022, (2 pages).

(Continued)

*Primary Examiner* — Tyler J Lee
(74) *Attorney, Agent, or Firm* — Oblon, McClelland, Maier & Neustadt, L.L.P.

(57) ABSTRACT

A work machine includes a lower travelling body, an upper slewing body, an attachment pivotably attached to the upper slewing body, and a control unit that controls each of a slewing action and a pivoting action. The control unit accepts, by teaching, an instruction corresponding to a series of actions including a plurality of action phases and including movements of the upper slewing body and the attachment, while controlling the slewing action and the pivoting action based on the instruction, based on a determination condition related to at least one of a position of the attachment, actions of the upper slewing body and the attachment, and a posture of the attachment, the control unit determines which action phase a current action phase is among the (Continued)

plurality of action phases, and divides and stores the instruction corresponding to the series of actions for each of the action phases.

7 Claims, 9 Drawing Sheets

(56) References Cited

U.S. PATENT DOCUMENTS

| | | | | |
|---|---|---|---|---|
| 10,968,601 | B2 * | 4/2021 | Hokkanen | E02F 3/43 |
| 11,648,887 | B2 * | 5/2023 | Pfaff | B60K 35/28 348/837 |
| 2006/0142990 | A1 * | 6/2006 | Vatchkov | G06N 3/0499 703/23 |
| 2007/0219662 | A1 * | 9/2007 | Sawodny | B66C 13/04 700/213 |
| 2019/0161939 | A1 * | 5/2019 | Hokkanen | E02F 9/265 |
| 2019/0161942 | A1 * | 5/2019 | Hokkanen | G06F 3/011 |
| 2021/0032848 | A1 * | 2/2021 | Wind | G05B 19/427 |
| 2021/0138969 | A1 | 5/2021 | Pfaff et al. | |
| 2022/0341131 | A1 | 10/2022 | Kamimura et al. | |

FOREIGN PATENT DOCUMENTS

| | | |
|---|---|---|
| JP | 9-256407 | 9/1997 |
| JP | 2001-90120 A | 4/2001 |
| JP | 2021-50576 A | 4/2021 |

OTHER PUBLICATIONS

Extended European Search Report issued Jan. 8, 2025 in European Patent Application No. 22895247.9, 10 pgs.

* cited by examiner

WORK MACHINE

TECHNICAL FIELD

The present invention relates to a work machine.

BACKGROUND ART

Patent literature 1 discloses an automatically operated excavator programmed with a plurality of instructional positions, which automatically performs the process from excavation to the removal of earth and sand based on the instructional positions.

CITATION LIST

Patent Literature

Patent Literature 1: JP 2001-90120 A

Incidentally, the time required for teaching can be reduced more when continuously performing teaching of a series of actions to a work machine than performing teaching for each of a plurality of action phases included in the series of actions. However, when performing teaching of a series of actions continuously, unlike when performing teaching for each of the plurality of action phases, the division of the action phases in the series of actions becomes unclear, which disables appropriate control for each action phase.

SUMMARY OF INVENTION

An object of the present invention is to provide a work machine that can perform control for each action phase even if teaching of a series of actions is performed continuously.

The present invention provides a work machine including: a lower travelling body; an upper slewing body slewably attached to the lower travelling body; an attachment pivotably attached to the upper slewing body; and a control unit that controls each of a slewing action of the upper slewing body and a pivoting action of the attachment, in which the control unit accepts, by teaching, an instruction corresponding to a series of actions including a plurality of action phases and including movements of the upper slewing body and the attachment, while controlling the slewing action and the pivoting action based on the instruction, based on a determination condition related to at least one of a position of the attachment, actions of the upper slewing body and the attachment, and a posture of the attachment, the control unit determines which action phase a current action phase is among the plurality of action phases, and divides and stores the instruction corresponding to the series of actions for each of the action phases based on a result of the determination.

DESCRIPTION OF EMBODIMENTS

A preferred embodiment of the present invention will be described below with reference to the drawings.

(Configuration of Work Machine)

Figure 1:
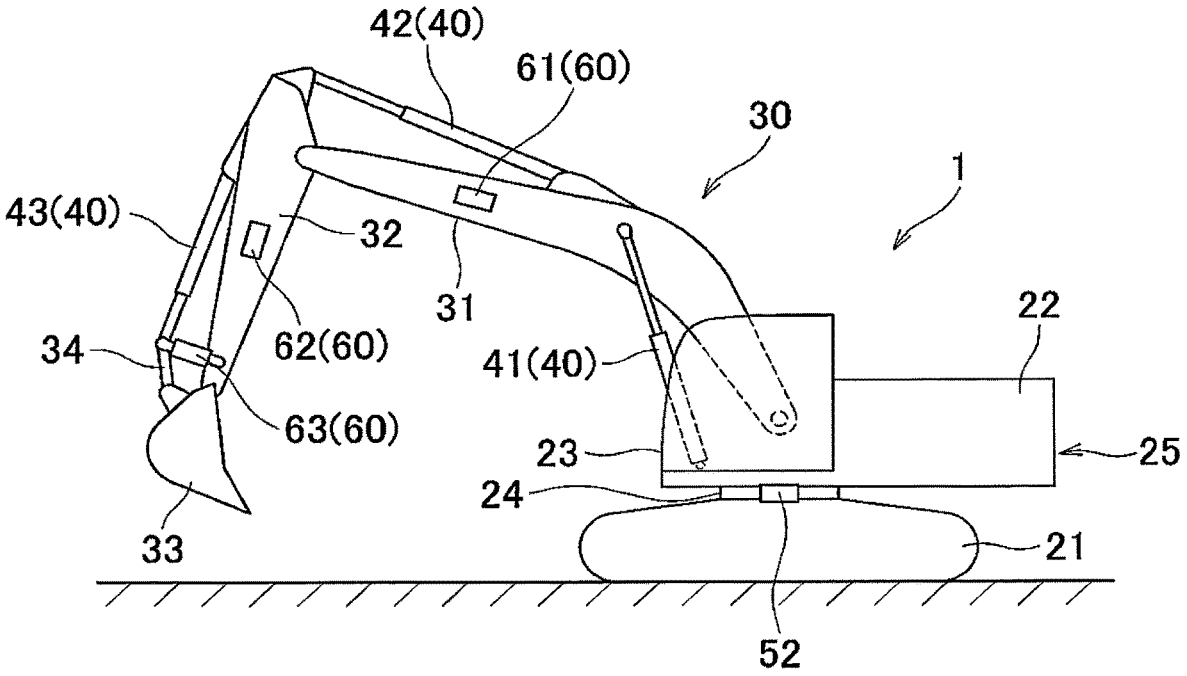
FIG. 1 is a side view of a work machine according to one embodiment of the present invention.

In the work machine according to the present embodiment, an instruction (instruction signal) regarding an action thereof is input and stored by teaching. The teaching is also referred to as direct teaching, a teaching method of instructing the action by an operator operating an operation unit, and is also referred to as a direct teaching method. FIG. 1 is a side view of the work machine 1. As shown in FIG. 1, the work machine 1 is a hydraulic excavator and includes a machine body 25 including a lower travelling body 21 and an upper slewing body 22, an attachment 30, and a work drive device 40.

The lower travelling body 21 includes one pair of crawlers and can travel on the ground by moving the pair of crawlers. The upper slewing body 22 is slewably attached to the lower travelling body 21 via a slewing device 24. The slewing device 24 is a slewing drive device that slews the upper slewing body 22. The upper slewing body 22 includes a cab (driver's cabin) 23 located at the front thereof. For example, the operation unit is disposed inside the cab 23.

The attachment 30 is a work device and is attached to the upper slewing body 22 to enable work actions including pivoting in the up-and-down direction. The attachment 30 includes a boom 31, an arm 32, and a bucket 33. The boom 31 includes a proximal end attached to the upper slewing body 22 to be pivotable in the up-and-down direction (can be raised and lowered) and a distal end on the opposite side. The arm 32 includes a proximal end attached to the distal end of the boom 31 to be pivotable in the up-and-down direction with respect to the boom 31 and a distal end on the opposite side. The bucket 33 is attached to the distal end of the arm 32 to be pivotable in the front-and-back direction with respect to the arm 32. The bucket 33 is a distal attachment that is a distal end of the attachment 30, and is a part that performs work such as excavation, leveling, and scooping of earth and sand. Note that the work object to be held by the bucket 33 is not limited to earth and sand, but may also be stones or waste (such as industrial waste). In addition, the distal attachment is not limited to the bucket 33, but may be a grapple, a lifting magnet, or the like.

The work drive device 40 hydraulically moves the attachment 30 to perform the work action. In the present embodiment, the work drive device 40 includes a plurality of hydraulic cylinders, each of which is extendable and retractable. The plurality of cylinders includes a boom cylinder 41, an arm cylinder 42, and a bucket cylinder 43.

The boom cylinder 41 causes the boom 31 to pivot with respect to the upper slewing body 22. The boom cylinder 41 includes a proximal end pivotably connected to the upper slewing body 22 and a distal end pivotably connected to the boom 31.

The arm cylinder 42 causes the arm 32 to pivot with respect to the boom 31. The arm cylinder 42 includes a proximal end pivotably connected to the boom 31 and a distal end pivotably connected to the arm 32.

The bucket cylinder 43 causes the bucket 33 to pivot with respect to the arm 32. The bucket cylinder 43 includes a proximal end pivotably connected to the arm 32 and a distal end pivotably connected to a link member 34. The link member 34 is pivotably connected to the bucket 33, and connects the bucket cylinder 43 and the bucket 33 to each other.

In addition, the work machine 1 further includes a slewing angle sensor 52, which is a slewing angle detector, and a work posture detector 60.

The slewing angle sensor 52 detects the slewing angle of the upper slewing body 22 with respect to the lower travelling body 21. The slewing angle sensor 52 is, for example, an encoder, a resolver, or a gyro sensor. In the present embodiment, when the front of the upper slewing body 22 agrees with the front of the lower travelling body 21, the slewing angle of the upper slewing body 22 is 0°.

The work posture detector 60 detects the work posture of the attachment 30. The work posture detector 60 includes a boom inclination angle sensor 61, an arm inclination angle sensor 62, and a bucket inclination angle sensor 63.

The boom inclination angle sensor 61 is attached to the boom 31 and detects the posture of the boom 31. The boom inclination angle sensor 61 acquires the inclination angle of the boom 31 with respect to the horizontal line. The boom inclination angle sensor 61 is, for example, an inclination (acceleration) sensor. Note that instead of the boom inclination angle sensor 61, the work posture detector 60 may include a rotation angle sensor that detects the rotation angle of a boom foot pin (boom proximal end) or a stroke sensor that detects the stroke amount of the boom cylinder 41.

The arm inclination angle sensor 62 is attached to the arm 32 and detects the posture of the arm 32. The arm inclination angle sensor 62 acquires the inclination angle of the arm 32 with respect to the horizontal line. The arm inclination angle sensor 62 is, for example, an inclination (acceleration) sensor. Note that instead of the arm inclination angle sensor 62, the work posture detector 60 may include a rotation angle sensor that detects the rotation angle of an arm connection pin (arm proximal end) or a stroke sensor that detects the stroke amount of the arm cylinder 42.

The bucket inclination angle sensor 63 is attached to the link member 34 and detects the posture of the bucket 33. The bucket inclination angle sensor 63 acquires the inclination angle of the bucket 33 with respect to the horizontal line. The bucket inclination angle sensor 63 is, for example, an inclination (acceleration) sensor. Note that instead of the bucket inclination angle sensor 63, the work posture detector 60 may include a rotation angle sensor that detects the rotation angle of a bucket connection pin (bucket proximal end) or a stroke sensor that detects the stroke amount of the bucket cylinder 43.

(Circuit Configuration of Work Machine)

Figure 2:
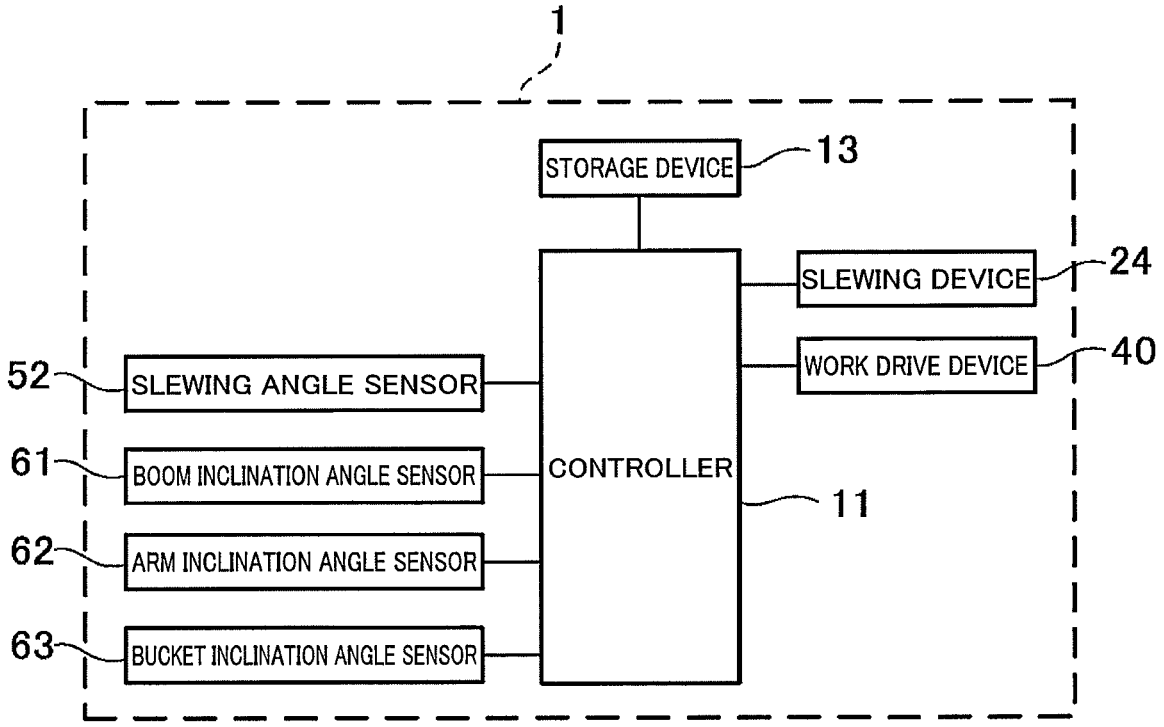
FIG. 2 is a circuit diagram of the work machine according to one embodiment of the present invention.

FIG. 2 is a circuit diagram of the work machine 1. As shown in FIG. 2, the work machine 1 includes a controller 11 and a storage device 13.

The controller 11 controls each of a plurality of actions of the work machine 1 including a slewing action of the upper slewing body 22 and a pivoting action of the attachment 30. Information regarding the slewing angle (posture) of the upper slewing body 22 with respect to the lower travelling body 21 detected by the slewing angle sensor 52 is input into the controller 11. In addition, information regarding the posture of the boom 31 detected by the boom inclination angle sensor 61 is input into the controller 11. In addition, information regarding the posture of the arm 32 detected by the arm inclination angle sensor 62 is input into the controller 11. In addition, information regarding the posture of the bucket 33 detected by the bucket inclination angle sensor 63 is input into the controller 11.

In the controller (control unit) 11, teaching of a series of actions is performed in an unbroken sequence (continuously). In this teaching, the controller 11 accepts an instruction corresponding to the series of actions including movements of the upper slewing body 22 and the attachment 30. Specifically, the operator operating the work machine 1 in the cab 23 performs (operates) a series of actions for the upper slewing body 22 and the attachment 30 in an unbroken sequence. As a result, the series of actions of the upper slewing body 22 and the attachment 30 are taught (stored) in the controller 11. In addition, in the present embodiment, while controlling the slewing action of the upper slewing body 22 and the pivoting action of the attachment 30 based on the above-described instruction, the controller 11 divides and stores the instruction corresponding to the series of actions for each action phase. Note that as one example, the series of actions in the present embodiment is the action of excavating and removing earth and sand.

Figure 3:
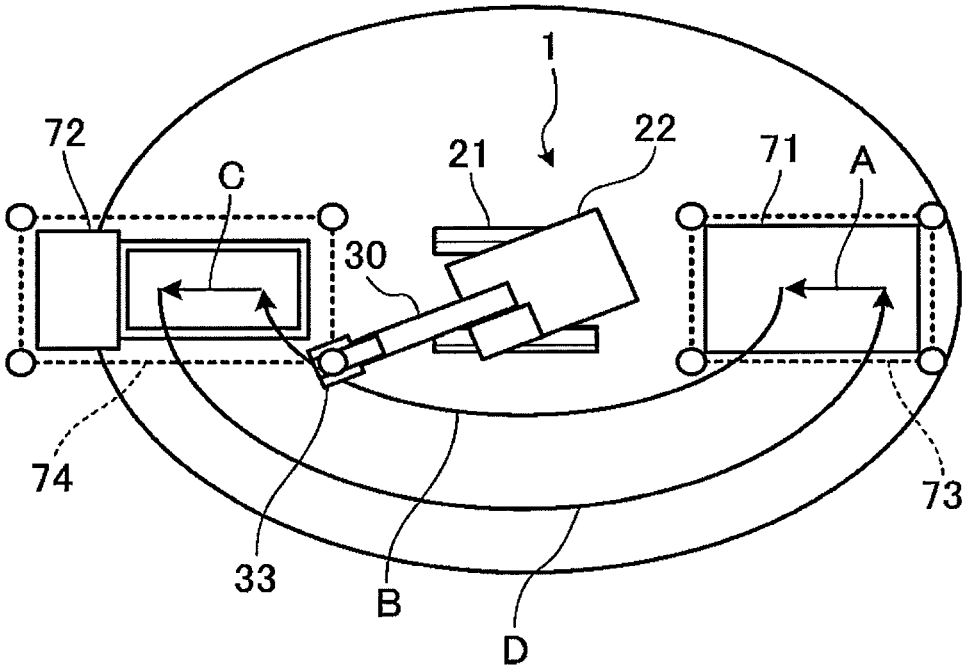
FIG. 3 is a top view of the work machine according to one embodiment of the present invention.

The series of actions includes a plurality of action phases. The action phase means a unit (section) of the work performed by the work machine 1. The series of actions corresponds to a combination of the plurality of action phases. FIG. 3 is a top view of the work machine 1. As shown in FIG. 3, the plurality of action phases includes excavation A, lifting and slewing B, earth removal C, and return slewing D. The excavation A is an action phase where the work machine 1 scoops earth and sand from an earth and sand pit 71 or the like. The lifting and slewing B is an action phase where the upper slewing body 22 slews while the work machine 1 is holding earth and sand with the bucket 33 such that the distal end of the bucket 33 is located on a loading platform of a dump truck 72 or the like. The earth removal C is an action phase where the work machine 1 removes earth and sand onto the loading platform of the dump truck 72. The return slewing D is an action phase of slewing the upper slewing body 22 such that the distal end of the bucket 33 is located above the earth and sand pit 71 or the like after the earth removal.

When the operator performs teaching of a series of actions for the work machine 1 in an unbroken sequence, the time required for teaching can be reduced more than when performing teaching for each action phase.

Returning to FIG. 2, the storage device 13 stores the series of actions taught by the teaching.

In addition, the controller 11 automatically controls the work machine 1. The controller 11 controls the upper slewing body 22 and the attachment 30 such that the upper slewing body 22 and the attachment 30 perform the series of actions stored by the teaching. That is, the work machine 1 is automatically operated after the teaching. Specifically, the controller 11 causes the slewing device 24 and the attachment 30 to operate automatically based on detection values of the slewing angle sensor 52 and the work posture detector 60.

The controller (setting unit) 11 sets a work area corresponding to at least one action phase before the teaching is performed. In the present embodiment, as shown in FIG. 3, the controller 11 sets a work area 73 corresponding to the excavation A and a work area 74 corresponding to the earth removal C.

The work area 73 is set by placing the distal end of the bucket 33 at each of four corners of the work area 73 and storing these positions by the controller 11. At this time, the operator operates the operation unit to sequentially place the distal end of the bucket 33 at the four corners. The work area 74 is also set in a similar way. The position of the distal end of the bucket 33 is calculated from the length of the attachment 30 (boom 31, arm 32, bucket 33) and the posture of the attachment 30. In this case, the relative position of the distal end of the bucket 33 with respect to the proximal end of the attachment 30 is calculated. Note that the controller 11 (region information acquisition unit) may acquire information regarding the work area 73 (region information) based on the distal end location of the bucket 33 as described above, or information regarding the work area 73 may be acquired by the operator from an input unit (not shown).

When the operator performs teaching of the series of actions, the controller (determination unit) 11 determines which action phase the current action phase is, among the plurality of action phases based on at least one related determination condition among the position of the attachment 30, the actions of the upper slewing body 22 and the attachment 30, and the posture of the attachment 30.

Specifically, the controller 11 detects the position of the attachment 30. More specifically, the controller 11 detects the position of the distal end of the bucket 33 from detection values of the slewing angle sensor 52 and the work posture detector 60 (either position detection unit). The controller 11 determines which action phase the current action phase is among the plurality of action phases based on the relationship between the work areas 73 and 74 (region information) and the position of the distal end of the bucket 33. In FIG. 3, when the distal end of the bucket 33 is located inside the work area 73, the controller 11 determines that the current action phase is the excavation A. In addition, when the distal end of the bucket 33 is located inside the work area 74, the controller 11 determines that the current action phase is the earth removal C.

Note that by the above determination method, even if the current action phase is the lifting and slewing B, if the distal end of the bucket 33 is located inside the work area 73, the controller 11 might determine that the current action phase is the excavation A. This is because, for example, immediately after the action phase switches from the excavation A to the lifting and slewing B, the distal end of the bucket 33 is located inside the work area 73. Note that a similar phenomenon may occur for the return slewing D.

Therefore, the controller (slewing determination unit) 11 preferably determines whether the upper slewing body 22 is slewing from the detection value (slewing information) of the slewing angle sensor 52 (slewing information acquisition unit). In this case, the controller 11 determines which action phase the current action phase is among the plurality of action phases based on whether the upper slewing body 22 is slewing. When the upper slewing body 22 is slewing, the current action phase is the lifting and slewing B or the return slewing D. Then, when the current action phase is the next action phase after the excavation A, the controller 11 determines that the current action phase is the lifting and slewing B. Meanwhile, when the current action phase is the next action phase after the earth removal C, the controller 11 determines that the current action phase is the return slewing D.

Figure 4:
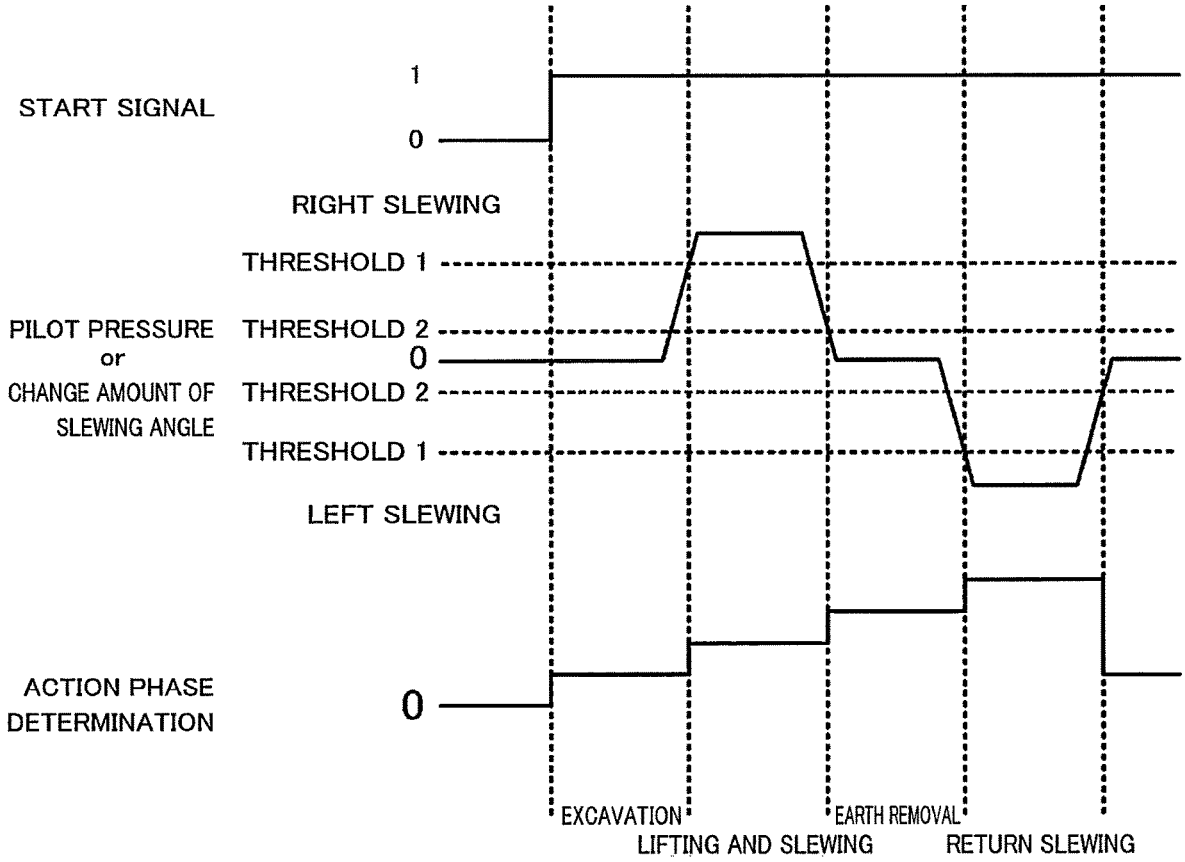
FIG. 4 is an explanatory diagram of switching determination in the work machine according to one embodiment of the present invention.

Here, the controller 11 can use the pilot pressure of the slewing device 24 or the change amount of the slewing angle for determining action phase switching. FIG. 4 is an explanatory diagram of such switching determination. Note that FIG. 4 shows threshold 1 and threshold 2 (0<threshold 2<threshold 1) in order to determine the lifting and slewing B and the return slewing D based on the pilot pressure of the slewing device 24 or the change amount of the slewing angle. As shown in FIG. 4, when the teaching is started, the start signal changes from 0 to 1. The start signal is a signal that is updated within the controller 11 as necessary. The teaching is performed in an unbroken sequence in the order of the excavation A, the lifting and slewing B, the earth removal C, and the return slewing D.

When the pilot pressure of the slewing device 24 or the change amount of the slewing angle exceeds the threshold 1, the controller 11 determines that the action phase has switched from the excavation A to the lifting and slewing B. Subsequently, when the pilot pressure of the slewing device 24 or the change amount of the slewing angle falls below the threshold 2, the controller 11 determines that the action phase has switched from the lifting and slewing B to the earth removal C. Subsequently, when the pilot pressure of the slewing device 24 or the change amount of the slewing angle exceeds the threshold 1, the controller 11 determines that the action phase has switched from the earth removal C to the return slewing D. Subsequently, when the pilot pressure of the slewing device 24 or the change amount of the slewing angle falls below the threshold 2, the controller 11 determines that the action phase has switched from the return slewing D to the excavation A.

Here, the controller 11 may calculate the change amount of the slewing angle by the difference in the moving average of the slewing angle. Specifically, the controller 11 uses the following formula (1) to calculate the angular acceleration at. By plotting the time variation of the angular acceleration at, the change amount of the slewing angle shown in FIG. 4 can be obtained. Here, $S_t$ is the slewing angle at time t.

$$a_t = Ave(S_t, S_{t-1}, \ldots, S_{t-N+1}) - Ave(S_{t-1}, S_{t-2}, \ldots, S_{t-N}) \quad \text{(formula 1)}$$

Figure 5A:
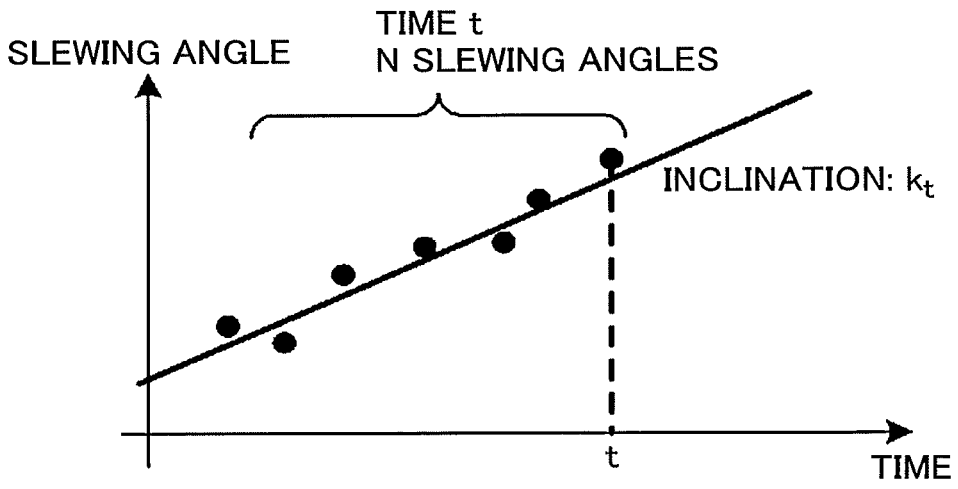
FIG. 5A is a graph showing a time variation of a slewing angle in the work machine according to one embodiment of the present invention.
Figure 5B:
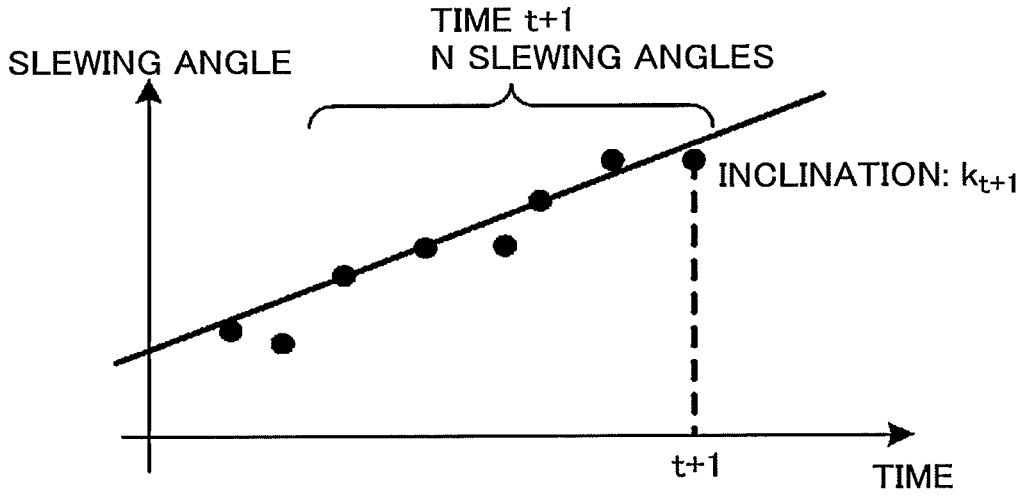
FIG. 5B is a graph showing the time variation of the slewing angle in the work machine according to one embodiment of the present invention.

In addition, the controller 11 may calculate the change amount of the slewing angle based on the difference in the inclination in the time variation of the slewing angle. FIGS. 5A and 5B are graphs showing the time variation of the slewing angle. As shown in FIGS. 5A and 5B, the controller 11 plots N slewing angles at time t and time t+1, and calculates the inclination $k_t$ and $k_{t+1}$, respectively. The inclination k is calculated using the least squares method. Then, by plotting the time variation of the difference in the calculated inclination, the change amount of the slewing angle shown in FIG. 4 can be obtained.

Returning to FIG. 2, the controller (classification unit, division unit) 11 divides and stores the instruction corresponding to the series of actions for each action phase based on determination results of the controller. Specifically, the controller 11 classifies the plurality of action phases included in the series of actions to the excavation A, the lifting and slewing B, the earth removal C, and the return slewing D. As described above, even if teaching of the series of actions is performed in an unbroken sequence for the work machine 1, the series of actions can be classified later for each action phase. Therefore, for example, appropriate control can be performed for each action phase.

In addition, as shown in FIG. 3, when the distal end of the bucket 33 is located inside the work area 73, the controller 11 can determine that the current action phase is the excavation A. Meanwhile, when the distal end of the bucket 33 is located inside the work area 74, the controller 11 can determine that the current action phase is the earth removal C. This allows the series of actions to be suitably classified for each action phase.

In addition, when the upper slewing body 22 slews after the excavation A, the controller 11 can determine that the current action phase is the lifting and slewing B. Meanwhile, when the upper slewing body 22 slews after the earth removal C, the controller 11 can determine that the current action phase is the return slewing D. This allows the series of actions to be suitably classified for each action phase.

Here, when the current action phase is the excavation A or the earth removal C, the upper slewing body 22 will not slew during the teaching. However, there are cases where the upper slewing body 22 slews by mistake during the excavation A or the earth removal C. In this case, there is a possibility that it is determined that the action phase has switched to the lifting and slewing B or the return slewing D. Therefore, the controller (posture detection means) 11 detects the posture of the attachment 30 from the detection value of the work posture detector 60 (posture detection unit).

Here, when the current action phase is the excavation A (specific phase), the controller 11 detects the height of the attachment 30. Specifically, the controller 11 detects the height of the distal end of the bucket 33.

Figure 6:
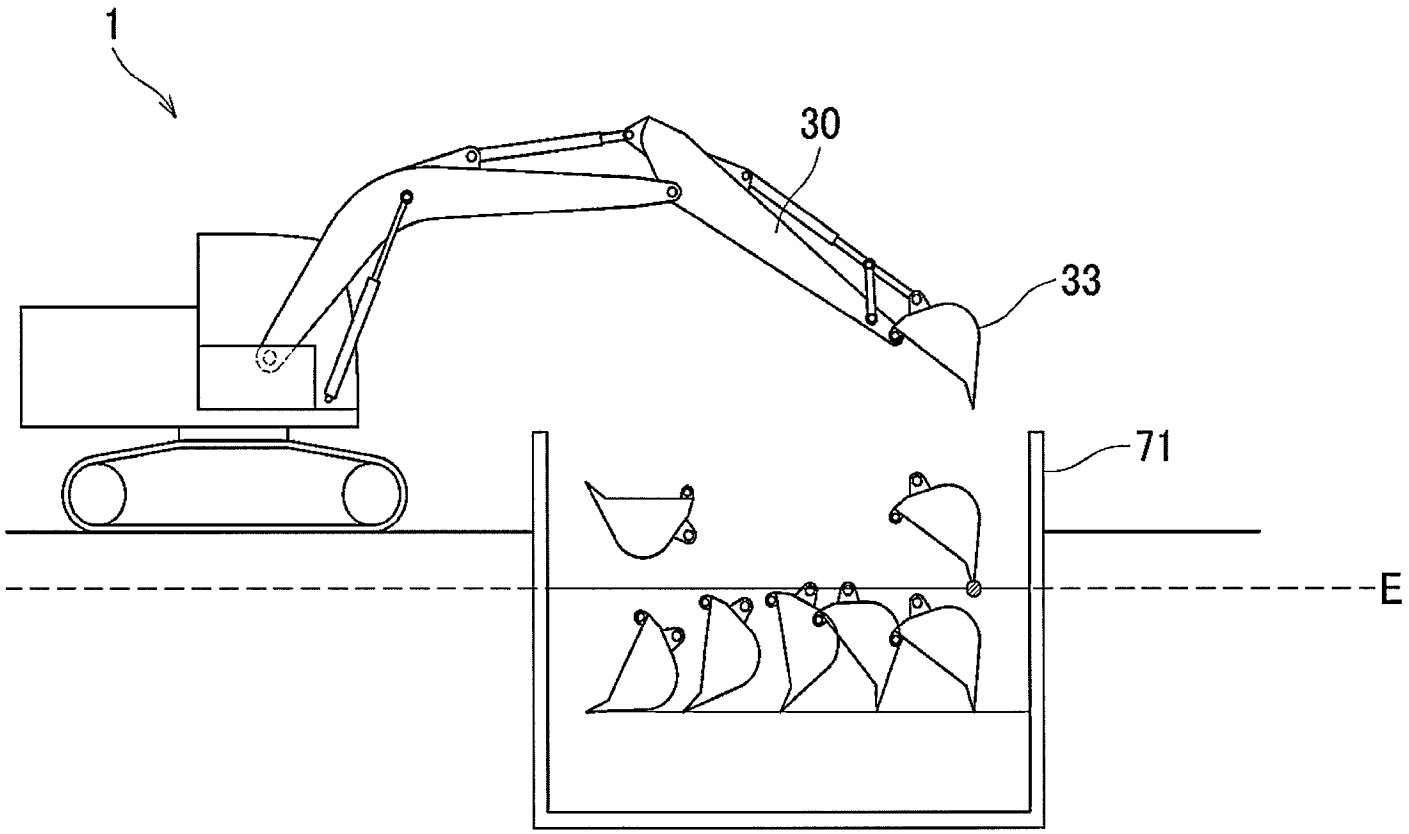
FIG. 6 is a side view of the work machine according to one embodiment of the present invention and is a view showing the height of the distal end of a bucket.

FIG. 6 is a side view of the work machine 1. As shown in FIG. 6, when excavating earth and sand with the bucket 33, the height of the distal end of the bucket 33 will be lower than a predetermined height E. Therefore, based on the height of the distal end of the bucket 33, the controller 11 can determine that the current action phase is the excavation A. Specifically, when the height of the distal end of the bucket 33 is lower than the predetermined height E, the controller 11 determines that the current action phase is the excavation A.

In addition, when the current action phase is the excavation A (specific phase), the controller 11 detects the angle of the attachment 30. Specifically, the angle of the bucket 33 relative to the ground is detected.

Figure 7:
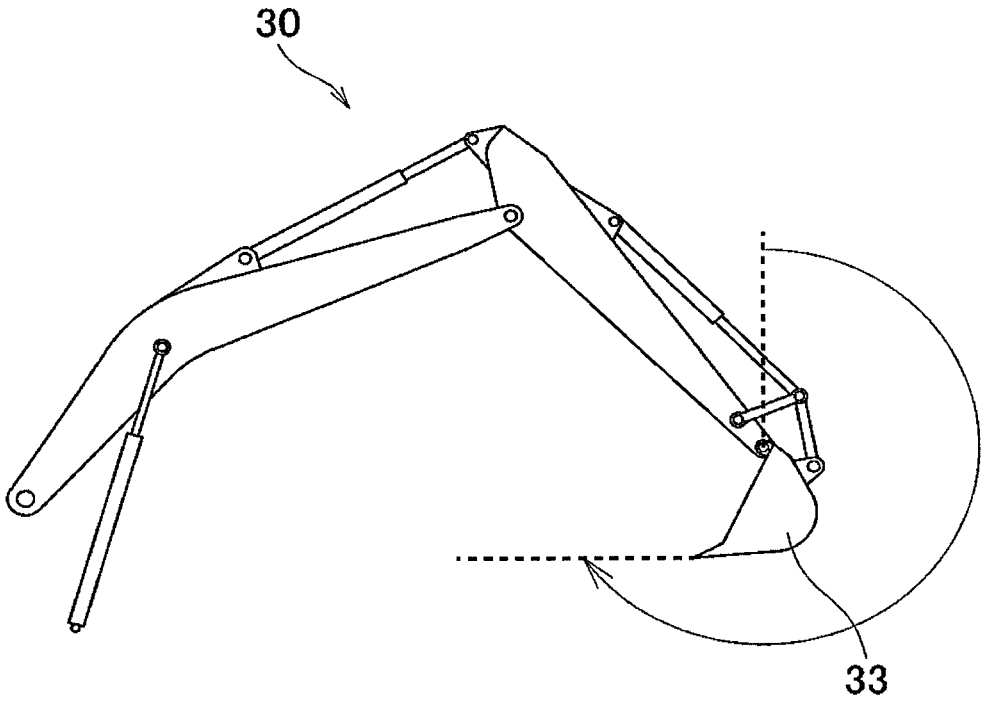
FIG. 7 is a side view of an attachment in the work machine according to one embodiment of the present invention.

FIG. 7 is a side view of the attachment 30. As shown in FIG. 7, when excavating earth and sand with the bucket 33, the angle of the bucket 33 relative to the ground will be 0° or more and 270° or less. Here, the angle of the bucket 33 relative to the ground is the angle from the vertical upward direction to the direction in which the toe of the bucket 33 is pointed, and the vertical upward direction is 0°. FIG. 7 illustrates a state where the angle of the bucket 33 relative to the ground is 270°. Based on the angle of the bucket 33 relative to the ground, the controller 11 determines that the current action phase is the excavation A. This is because when the bucket 33 excavates the ground or the like, the bucket 33 acts within the above-described angle range.

In addition, when the current action phase is the earth removal C (specific phase), the controller 11 detects the angle of the bucket 33 relative to the ground. As shown in FIG. 7, when removing earth from the bucket 33, the angle of the bucket 33 relative to the ground will be 270° or less. Based on the angle of the bucket 33 relative to the ground, the controller 11 determines that the current action phase is the earth removal C.

As described above, when the controller 11 determines that the current action phase is the excavation A based on at least one of the height of the distal end of the bucket 33 and the angle of the bucket 33 relative to the ground, the excavation determination becomes ON. While the excavation determination is ON, even if the upper slewing body 22 slews, the determination that the current action phase is the excavation A continues.

Meanwhile, as described above, when the controller 11 determines that the current action phase is the earth removal C based on the angle of the bucket 33 relative to the ground, the earth removal determination becomes ON. While the earth removal determination is ON, even if the upper slewing body 22 slews, the determination that the current action phase is the earth removal C continues.

In this way, based on the height of the distal end of the bucket 33 and the angle of the bucket 33 relative to the ground, it can be determined that the current action phase is the excavation A. This allows the excavation A to be suitably classified from the series of actions.

In addition, based on the angle of the bucket 33 relative to the ground, it can be determined that the current action phase is the earth removal C. This allows the earth removal C to be suitably classified from the series of actions.

Here, if the current action phase is the lifting and slewing B or the return slewing D during teaching, the operator does not intentionally stop the slewing of the upper slewing body 22 halfway, but the upper slewing body 22 may stop the slewing by mistake during the lifting and slewing B or the return slewing D. In this case, there is a possibility that the controller 11 determines that the action phase has switched to the excavation A or the earth removal C. However, even in such a case, the angle of the bucket 33 relative to the ground is detected, and depending on the detection result, the controller 11 can determine that the current action phase is the lifting and slewing B or the return slewing D. That is, when the angle of the bucket 33 relative to the ground is greater than 270°, the controller 11 determines that the current action phase is not the excavation A or the earth removal C.

Returning to FIG. 2, the controller (changeability classification unit) 11 classifies the action phase classified by the controller 11 (action phase corresponding to the instruction divided by teaching) into a changeable phase and an unchangeable phase. The changeable phase is an action phase in which the action of the upper slewing body 22 and the attachment 30 is changeable from the action for which teaching is performed. In other words, the changeable phase is an action phase in which it is permitted to perform the action of the upper slewing body 22 and the attachment 30 different from the action included in the teaching after the teaching. Meanwhile, the unchangeable phase is an action phase in which the action of the upper slewing body 22 and the attachment 30 is unchangeable from the action for which teaching is performed. In other words, the unchangeable phase is an action phase in which performing any action of the upper slewing body 22 and the attachment 30 different from the action included in the teaching after the teaching is prohibited.

During automatic operation, in the changeable phase, the controller 11 may control the upper slewing body 22 and the attachment 30 in a way changed from the way previously defined by the teaching. Specifically, for the purpose of performing appropriate control after the teaching, in the changeable phase, the controller 11 may compensate for the movements of the upper slewing body 22 and the attachment 30, such as the route of the distal end of the bucket 33 and the slewing speed of the attachment 30. In this case, in the changeable phase, the movements of the upper slewing body 22 and the attachment 30 can be made more efficient.

Meanwhile, during automatic operation, the controller 11 controls the upper slewing body 22 and the attachment 30 such that the action of the upper slewing body 22 and the attachment 30 in the unchangeable phase included in the teaching is reproduced in the unchangeable phase after the teaching.

In the present embodiment, the excavation A and the earth removal C are changeable phases, and the lifting and slewing B and the return slewing D are unchangeable phases. When performing teaching of the series of actions, in the lifting and slewing B or the return slewing D, if the teaching of the movement to avoid obstacles or movement to follow the optimal route is performed, these movements during the lifting and slewing B and the return slewing D will be reproduced during automatic operation after the teaching. Therefore, in such a case, safe automatic operation or efficient automatic operation can be performed.

Figure 8:
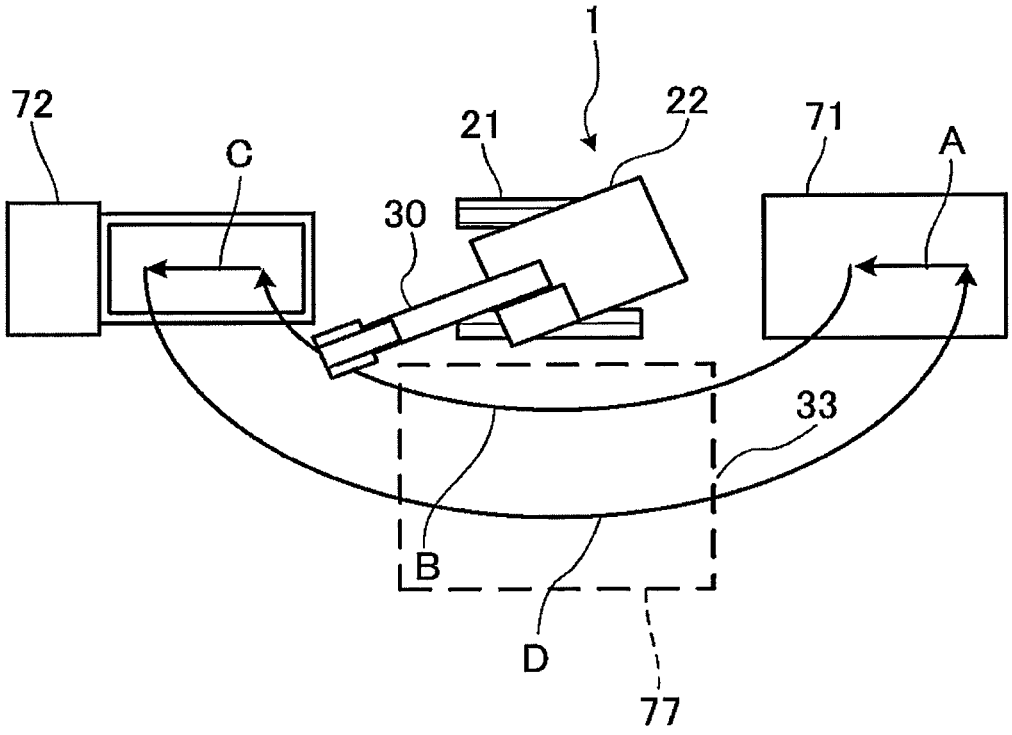
FIG. 8 is a top view of the work machine according to one embodiment of the present invention and is a view showing a changeless area.

In addition, FIG. 8 is a top view of the work machine 1. As shown in FIG. 8, before teaching is performed, the controller (changeless region setting unit) 11 sets a changeless area 77 (changeless region) inside the action range of the upper slewing body 22 and the attachment 30. The changeless area 77 is an area in which the action of the upper slewing body 22 and the attachment 30 is unchangeable from the action for which teaching is performed (area where change is prohibited).

During automatic operation, in an area other than the changeless area 77, the controller 11 may control the upper slewing body 22 and the attachment 30 in a way changed from the way defined by the teaching. Specifically, for the purpose of performing appropriate control after the teaching, in the area other than the changeless area 77, the controller 11 may compensate for the movements of the upper slewing body 22 and the attachment 30, such as the route of the distal end of the bucket 33 and the slewing speed of the attachment 30. In this case, in the area other than the changeless area 77, the movements of the upper slewing body 22 and the attachment 30 can be made more efficient.

Meanwhile, during automatic operation, the controller 11 controls the upper slewing body 22 and the attachment 30 such that the action in the changeless area 77 included in the teaching will be reproduced in the changeless area 77 after the teaching.

In the present embodiment, the changeless area 77 is set inside the action range of the lifting and slewing B and the return slewing D. During teaching of a series of actions, in the changeless area 77, when teaching of movement to avoid obstacles or movement to follow the optimal route is performed, these movements are reproduced in the changeless area 77 during automatic operation. Therefore, in such a case, safe automatic operation or efficient automatic operation can be performed.

(Action of Work Machine)

Figure 9:
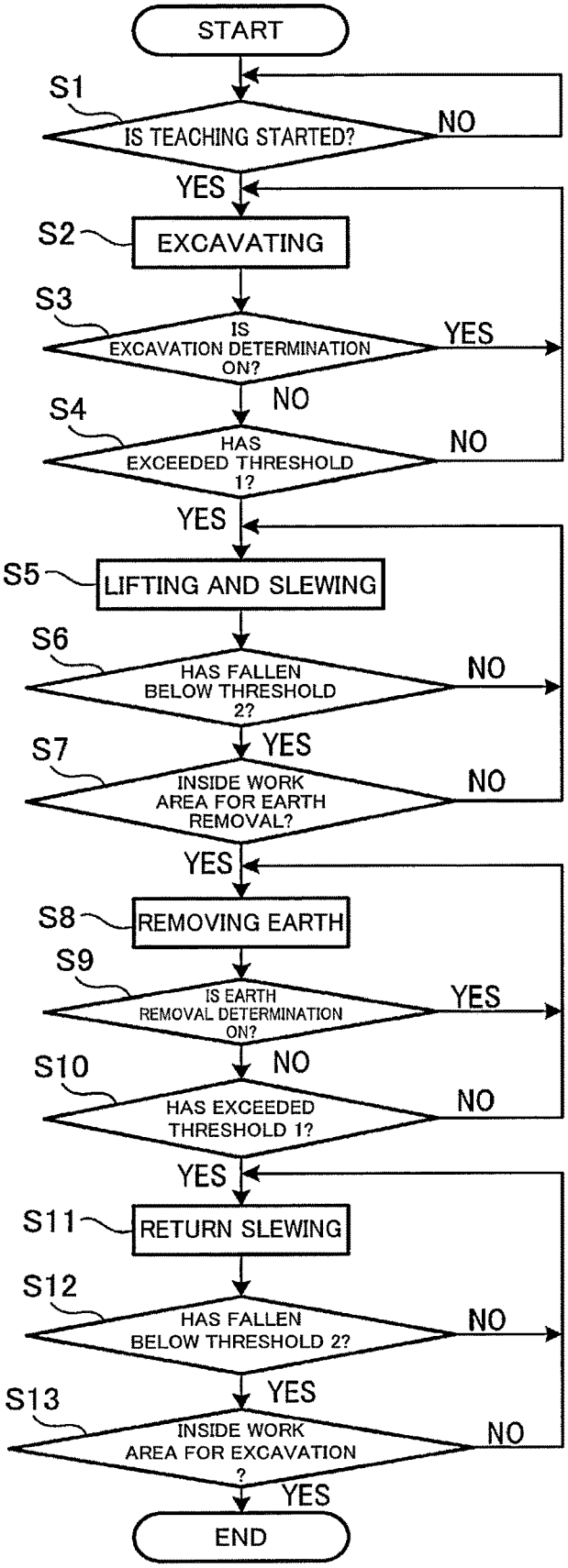
FIG. 9 is a flowchart of an action phase classification process in the work machine according to one embodiment of the present invention.

FIG. 9 is a flowchart of an action phase classification process. With reference to FIG. 9, the action of the work machine 1 will be described. The action phase classification process is performed simultaneously with the teaching.

First, the controller 11 determines whether the teaching has been started (step S1). When it is determined in step S1 that the teaching has not been started (S1: NO), the controller 11 repeats step S1. Meanwhile, when it is determined in step S1 that the teaching has been started (S1: YES), the controller 11 determines that the current action is excavation (step S2). That is, the controller 11 determines that the current action phase is the excavation A. At this time, as described above, the excavation A may be determined based on the angle of the bucket 33.

Next, the controller 11 determines whether the excavation determination is ON (step S3). When it is determined in step S3 that the excavation determination is ON (S3: YES), the controller 11 returns to step S2. While the excavation determination is ON, even if the upper slewing body 22 slows, it will not be determined that the excavation A has finished. Meanwhile, when it is determined in step S3 that the excavation determination is not ON (S3: NO), the controller 11 determines whether the pilot pressure of the slewing device 24 or the change amount of the slewing angle shown in FIG. 4 has exceeded the threshold 1 (step S4).

When it is determined in step S4 that the pilot pressure of the slewing device 24 or the change amount of the slewing angle has not exceeded the threshold 1 (S4: NO), the controller 11 returns to step S2. Meanwhile, when it is determined in step S4 that the pilot pressure of the slewing device 24 or the change amount of the slewing angle has exceeded the threshold 1 (S4: YES), the controller 11 determines that the current action is lifting and slewing (step S5). That is, it is determined that the current action phase is the lifting and slewing B.

Next, the controller 11 determines whether the pilot pressure of the slewing device 24 or the change amount of the slewing angle shown in FIG. 4 has fallen below the threshold 2 (step S6). When it is determined in step S6 that the pilot pressure of the slewing device 24 or the change amount of the slewing angle is not below the threshold 2 (S6: NO), the controller 11 returns to step S5. Meanwhile, when it is determined in step S6 that the pilot pressure of the slewing device 24 or the change amount of the slewing angle has fallen below the threshold 2 (S6: YES), the controller 11 determines whether the distal end of the bucket 33 is located inside the work area 74 shown in FIG. 3 (step S7).

When it is determined in step S7 that the distal end of the bucket 33 is not located inside the work area 74 shown in FIG. 3 (S7: NO), the controller 11 returns to step S5. Meanwhile, when it is determined in step S7 that the distal end of the bucket 33 is located inside the work area 74 shown in FIG. 3 (S7: YES), the controller 11 determines that the current action is earth removal (step S8). That is, it is determined that the current action phase is the earth removal C.

Next, the controller 11 determines whether the earth removal determination is ON (step S9). When it is determined in step S9 that the earth removal determination is ON (S9: YES), the controller 11 returns to step S8. While the earth removal determination is ON, even if the upper slewing body 22 slews, it will not be determined that the earth removal C has finished.

Meanwhile, when it is determined in step S9 that the earth removal determination is not ON (S9: NO), the controller 11 determines whether the pilot pressure of the slewing device 24 or the change amount of the slewing angle shown in FIG. 4 has exceeded the threshold 1 (step S10).

When it is determined in step S10 that the pilot pressure of the slewing device 24 or the change amount of the slewing angle has not exceeded the threshold 1 (S10: NO), the controller 11 returns to step S8. Meanwhile, when it is determined in step S10 that the pilot pressure of the slewing device 24 or the change amount of the slewing angle has exceeded the threshold 1 (S10: YES), the controller 11 determines that the current action is return slewing (step S11). That is, it is determined that the current action phase is the return slewing D.

Next, the controller 11 determines whether the pilot pressure of the slewing device 24 or the change amount of the slewing angle shown in FIG. 4 has fallen below the threshold 2 (step S12). When it is determined in step S12 that the pilot pressure of the slewing device 24 or the change amount of the slewing angle is not below the threshold 2 (S12: NO), the controller 11 returns to step S11. Meanwhile, when it is determined in stop S12 that the pilot pressure of the slewing device 24 or the change amount of the slewing angle has fallen below the threshold 2 (S12: YES), the controller 11 determines whether the distal end of the bucket 33 is located inside the work area 73 shown in FIG. 3 (step S13).

When it is determined in step S13 that the distal end of the bucket 33 is not located inside the work area 73 shown in FIG. 3 (S13: NO), the controller 11 returns to step S11. Meanwhile, when it is determined in step S13 that the distal end of the bucket 33 is located inside the work area 73 shown in FIG. 3 (S13: YES), the controller 11 determines that the return slewing D has finished and finishes the flow.

As described above, with the work machine 1 according to the present embodiment, the current action phase is determined based on at least one of the position of the attachment 30, the action of the upper slewing body 22 and the attachment 30, and the posture of the attachment 30. Then, based on the determination result, a series of actions is classified into a plurality of action phases. When performing teaching of a series of actions for the work machine 1 in an unbroken sequence, the time required for teaching can be reduced more than when performing teaching for each action phase. Then, even if teaching of the series of actions is performed in an unbroken sequence for the work machine 1, the series of actions can be classified later for each action phase. Therefore, for example, appropriate control can be performed for each action phase. In other words, in the present embodiment, the controller 11 can specify the boundary (delimiter) of the action phase included in the series of actions based on at least one of the position of the attachment 30, the action of the upper slewing body 22 and the attachment 30, and the posture of the attachment 30. As a result, in future automatic control and the like, it becomes possible to perform unique control over the specific action phase without affecting neighboring action phases.

In addition, the controller 11 can determine the current action phase based on the relationship between the preset work area 73 or 74 and the position of the attachment 30. For example, when the distal end of the bucket 33 is located inside the work area 73 or 74, the controller 11 can determine that the current action phase is the action phase corresponding to the work area 73 or 74. This allows the series of actions to be suitably classified for each action phase.

In addition, the current action phase is determined based on whether the upper slewing body 22 is slewing. For example, in a case where the action phases included in the series of actions are the excavation A, the lifting and slewing B, the earth removal C, and the return slewing D, when the upper slewing body 22 slews after the excavation A, the controller 11 can determine that the current action phase is the lifting and slewing B. This allows the series of actions to be suitably classified for each action phase.

In addition, the controller 11 determines that the current action phase is the specific phase based on the posture of the attachment 30. For example, when the action phases included in the series of actions are the excavation A, the lifting and slewing B, the earth removal C, and the return slewing D, and when the specific phase is the excavation A, the controller 11 can determine that the current action phase is the excavation A based on the posture of the attachment 30 (for example, height and angle of the bucket 33). This allows the specific phase to be suitably classified from the series of actions.

In addition, when the specific phase is the action phase of excavating earth and sand with the attachment 30, the controller 11 can determine that the current action phase is the specific phase based on the height of the distal end of the bucket 33. This allows the specific phase to be suitably classified from the series of actions.

In addition, the specific phase is the action phase of excavating earth and sand with the attachment 30 or the action phase of releasing earth and sand from the attachment 30, and based on the angle of the bucket 33 (attachment 30), it is determined that the current action phase is the specific phase. This allows the specific phase to be suitably classified from the series of actions.

In addition, the action phases are classified into the changeable phase in which the action of the upper slewing body 22 and the attachment 30 can be changed from the action for which teaching is performed, and the unchangeable phase in which the action of the upper slewing body 22 and the attachment 30 cannot be changed from the action for which teaching is performed. Then, in the unchangeable phase, the upper slewing body 22 and the attachment 30 are controlled such that the action for which teaching is performed is reproduced. During teaching of a series of actions, in the unchangeable phase, when teaching of movement to avoid obstacles or movement to follow the optimal route is performed, these movements are reproduced in the unchangeable phase during automatic operation. Therefore, in such a case, safe automatic operation or efficient automatic operation can be performed.

In addition, the changeless area 77 may be set inside the action range of the upper slewing body 22 and the attachment 30. In the changeless area 77, it is prohibited to change the action of the upper slewing body 22 and the attachment 30 from the action for which teaching is performed. Then, the upper slewing body 22 and the attachment 30 are controlled such that the action for which teaching is performed is reproduced in the changeless area 77. During teaching of a series of actions, when teaching of movement to avoid obstacles or movement to follow the optimal route is performed in the changeless area 77, these movements are reproduced in the changeless area 77 during automatic operation. Therefore, in such a case, safe automatic operation or efficient automatic operation can be performed.

Although one embodiment of the present invention has been described above, only a specific example has been illustrated, and the present invention is not particularly limited to the embodiment. Therefore, the specific configuration and the like can be modified in design as appropriate. In addition, the actions and effects described in the embodiment of the invention merely recite the most suitable actions and effects resulting from the present invention, and the actions and effects according to the present invention are not limited to those described in the embodiment of the present invention.

According to the present invention, the current action phase is determined based on at least one of the position of the attachment, the action of the upper slewing body and the attachment, and the posture of the attachment. Then, based on the determination result, a series of actions is classified into a plurality of action phases. When performing teaching of a series of actions for the work machine in an unbroken sequence, the time required for teaching can be reduced more than when performing teaching for each action phase. Then, even if teaching of the series of actions is performed in an unbroken sequence for the work machine, the series of actions can be classified later for each action phase. Therefore, for example, appropriate control can be performed for each action phase.

The present invention provides a work machine. The work machine includes: a lower travelling body; an upper slewing body slewably attached to the lower travelling body; an attachment pivotably attached to the upper slewing body; and a control unit that controls each of a slewing action of the upper slewing body and a pivoting action of the attachment. The control unit accepts, by teaching, an instruction corresponding to a series of actions including a plurality of action phases and including movements of the upper slewing body and the attachment, while controlling the slewing action and the pivoting action based on the instruction, based on a determination condition related to at least one of a position of the attachment, actions of the upper slewing body and the attachment, and a posture of the attachment, the control unit determines which action phase a current action phase is among the plurality of action phases, and divides and stores the instruction corresponding to the series of actions for each of the action phases based on a result of the determination.

In the above configuration, the work machine may further include a position detection unit that detects the position of the attachment, in which the control unit may acquire region information that is information about a work region corresponding to at least one of the action phases, and determine which action phase the current action phase is among the plurality of action phases based on the region information and the position of the attachment detected by the position detection unit.

In the above configuration, the work machine may further include a slewing information acquisition unit that acquires slewing information that is information indicating whether the upper slewing body is slewing, in which the control unit may determine which action phase the current action phase is among the plurality of action phases based on the slewing information acquired by the slewing information acquisition unit.

In the above configuration, the plurality of action phases may include a specific phase, the work machine may further include a posture detection unit that detects the posture of the attachment, and the control unit may determine whether the current action phase is the specific phase based on the posture of the attachment detected by the posture detection unit.

In the above configuration, the specific phase may be the action phase of excavating earth and sand with the attachment, the posture detection unit may be capable of detecting a height of the attachment, and the control unit may determine whether the current action phase is the specific phase based on the height of the attachment detected by the posture detection unit.

In the above configuration, the specific phase may be the action phase of excavating earth and sand with the attachment or the action phase of releasing earth and sand from the attachment, the posture detection unit may be capable of detecting an angle of the attachment, and the control unit may determine whether the current action phase is the specific phase based on the angle of the attachment detected by the posture detection unit.

In the above configuration, the control unit may classify the action phase corresponding to the divided instruction into a changeable phase and an unchangeable phase, the changeable phase may be the action phase in which it is permitted to perform the action of the upper slewing body and the attachment different from the action included in the teaching after the teaching, the unchangeable phase may be the action phase in which it is prohibited to perform the action of the upper slewing body and the attachment different from the action included in the teaching after the teaching, and the control unit may control the upper slewing body and the attachment such that the action of the upper slewing body and the attachment in the unchangeable phase included in the teaching is reproduced in the unchangeable phase after the teaching.

In the above configuration, the control unit may: set a changeless region inside an action range of the upper slewing body and the attachment; prohibit the action of the upper slewing body and the attachment from being changed from the action included in the teaching inside the changeless region; and control the upper slewing body and the attachment such that the action in the changeless region included in the teaching is reproduced in the changeless region after the teaching.

The invention claimed is:

1. A work machine comprising:

a lower travelling body;

an upper slewing body slewably attached to the lower travelling body;

an attachment pivotably attached to the upper slewing body;

a control unit that controls each of a slewing action of the upper slewing body and a pivoting action of the attachment; and a position detection unit that detects the position of the attachment, wherein the control unit accepts, by teaching, an instruction corresponding to a series of actions including a plurality of action phases and including movements of the upper slewing body and the attachment, while controlling the slewing action and the pivoting action based on the instruction, based on a determination condition related to at least one of a position of the attachment, actions of the upper slewing body and the attachment, and a posture of the attachment, the control unit determines which action phase a current action phase is among the plurality of action phases, and divides and stores the instruction corresponding to the series of actions for each of the action phases based on a result of the determination, wherein the control unit acquires region information that is information about a work region corresponding to at least one of the action phases, and determines which action phase the current action phase is among the plurality of action phases based on the region information and the position of the attachment detected by the position detection unit, the work region being a region where the work machine actually performs work.

2. The work machine according to claim 1, wherein the plurality of action phases includes a specific phase, the work machine further includes a posture detection unit that detects the posture of the attachment, and the control unit determines whether the current action phase is the specific phase based on the posture of the attachment detected by the posture detection unit.

3. The work machine according to claim 1, wherein the plurality of action phases includes a specific phase, the work machine further includes a posture detection unit that detects the posture of the attachment, and the control unit determines whether the current action phase is the specific phase based on the posture of the attachment detected by the posture detection unit.

4. The work machine according to claim 3, wherein the specific phase is the action phase of excavating earth and sand with the attachment, the posture detection unit is capable of detecting a height of the attachment, and the control unit determines whether the current action phase is the specific phase based on the height of the attachment detected by the posture detection unit.

5. The work machine according to claim 3, wherein the specific phase is the action phase of excavating earth and sand with the attachment or the action phase of releasing earth and sand from the attachment, the posture detection unit is capable of detecting an angle of the attachment, and the control unit determines whether the current action phase is the specific phase based on the angle of the attachment detected by the posture detection unit.

6. A work machine comprising:

a lower travelling body;

an upper slewing body slewably attached to the lower travelling body;

an attachment pivotably attached to the upper slewing body; and a control unit that controls each of a slewing action of the upper slewing body and a pivoting action of the attachment, wherein the control unit accepts, by teaching, an instruction corresponding to a series of actions including a plurality of action phases and including movements of the upper slewing body and the attachment, while controlling the slewing action and the pivoting action based on the instruction, based on a determination condition related to at least one of a position of the attachment, actions of the upper slewing body and the attachment, and a posture of the attachment, the control unit determines which action phase a current action phase is among the plurality of action phases, and divides and stores the instruction corresponding to the series of actions for each of the action phases based on a result of the determination, wherein the control unit classifies the action phase corresponding to the divided instruction into a changeable phase and an unchangeable phase, the changeable phase is the action phase in which it is permitted to perform the action of the upper slewing body and the attachment different from the action included in the teaching after the teaching, the unchangeable phase is the action phase in which it is prohibited to perform the action of the upper slewing body and the attachment different from the action included in the teaching after the teaching, and the control unit controls the upper slewing body and the attachment such that the action of the upper slewing body and the attachment in the unchangeable phase included in the teaching is reproduced in the unchangeable phase after the teaching.

7. The work machine according to claim 1, wherein the control unit sets a changeless region inside an action range of the upper slewing body and the attachment, prohibits the action of the upper slewing body and the attachment from being changed from the action included in the teaching inside the changeless region, and controls the upper slewing body and the attachment such that the action in the changeless region included in the teaching is reproduced in the changeless region after the teaching.

* * * * *